US005765702A

United States Patent [19]

Bustos et al.

[11] Patent Number: 5,765,702

[45] Date of Patent: Jun. 16, 1998

[54] WHEELED MERCHANDISE DISPLAY RACK

[75] Inventors: Rafael T. Bustos, Alpharetta; Joseph Marcus Battaglia, Douglasville, both of Ga.

[73] Assignee: L&P Property Management Company, South Gate, Calif.

[21] Appl. No.: 810,460

[22] Filed: Mar. 4, 1997

[51] Int. Cl.[6] ..... A47F 5/00

[52] U.S. Cl. ..... 211/181.1; 211/149; 280/79.3; 280/47.21

[58] Field of Search ..... 211/181.1, 195, 211/149; 280/79.3, 47.19, 47.21, 47.35

[56] References Cited

U.S. PATENT DOCUMENTS

| | | |
|---|---|---|
| 1,013,685 | 1/1912 | Reach . |
| 1,409,838 | 3/1922 | Emery et al. . |
| 2,450,690 | 10/1948 | Robins . |
| 2,562,686 | 7/1951 | Altemus . |
| 2,745,673 | 5/1956 | Koepke et al. . |
| 2,765,090 | 10/1956 | Halls . |
| 2,767,996 | 10/1956 | Seyforth . |
| 2,802,672 | 8/1957 | D'Angelo . |
| 2,803,469 | 8/1957 | Pfisterer . |
| 2,899,212 | 8/1959 | Mayer . |
| 2,918,295 | 12/1959 | Milner . |
| 2,925,283 | 2/1960 | Stilger . |
| 3,014,733 | 12/1961 | Higginbotham . |
| 3,043,603 | 7/1962 | Major, Sr. . |
| 3,194,576 | 7/1965 | Kunkle . |
| 3,241,852 | 3/1966 | Muller et al. . |
| 3,332,558 | 7/1967 | Wilson . |
| 3,572,742 | 3/1971 | Marker . |
| 3,659,867 | 5/1972 | Curry . |
| 3,677,573 | 7/1972 | Chin . |
| 3,735,996 | 5/1973 | Rath . |
| 3,840,242 | 10/1974 | Craig, Sr. et al. . |
| 4,249,282 | 2/1981 | Little . |
| 4,315,632 | 2/1982 | Taylor . |
| 4,448,434 | 5/1984 | Anderson . |
| 4,537,421 | 8/1985 | Teachout . |
| 4,570,958 | 2/1986 | Walker . |
| 4,624,467 | 11/1986 | Burns . |
| 4,705,280 | 11/1987 | Burns . |
| 4,917,392 | 4/1990 | Ambasz . |
| 4,969,660 | 11/1990 | Spak . |
| 4,978,013 | 12/1990 | Hogg . |
| 4,989,889 | 2/1991 | Server Perez . |
| 4,993,727 | 2/1991 | vom Braucke et al. . |
| 5,024,458 | 6/1991 | Kazmark et al. . |
| 5,072,958 | 12/1991 | Young . |
| 5,127,662 | 7/1992 | Spak . |
| 5,312,006 | 5/1994 | Lag . |
| 5,429,378 | 7/1995 | Durel-Crain . |
| 5,468,005 | 11/1995 | Yang . |

FOREIGN PATENT DOCUMENTS

| | | |
|---|---|---|
| 3806754 | 9/1989 | Germany . |

*Primary Examiner*—Robert W. Gibson, Jr.
*Attorney, Agent, or Firm*—Wood, Herron & Evans, L.L.P.

[57] ABSTRACT

A wheeled display rack comprising a back panel, two side panels connected to the edges of the back panel, a plurality of removable shelves and a wheeled support including rotatable wheels. The wheeled support is movable between an active position in which the display rack may be supported by the wheeled support and an inactive position in which the display rack may not be supported by the wheeled support. In one embodiment the wheeled support comprises a wheel carriage and the side panels may or may not be collapsible. In another embodiment, the wheeled support comprises rear frame members of side panels which must be collapsible in order for the wheeled support to reach its active position.

32 Claims, 3 Drawing Sheets

WHEELED MERCHANDISE DISPLAY RACK

FIELD OF THE INVENTION

The present invention relates to a wheeled display rack which may be easily moved and conveniently stored when empty but which is difficult or impossible to roll and move when loaded or full of displayed product.

BACKGROUND OF THE INVENTION

Merchandise is typically displayed on shelved structures placed within retail and other stores. On some occasions these display racks have been equipped with wheels to facilitate transport of the display racks within the store. However, commonly these wheeled display racks are loaded full of product and then wheeled to and from desired locations within the store. With the display rack being full of product during the transport of the display rack from one location to another, the product on the shelves of the display rack may move and become damaged either while on the shelves of the display rack or by falling off the shelves of the display rack. Worse yet, while being rolled from one site to another, the display rack as a whole may tip over either forwardly, backwardly or sideways if the weight of the product accidentally shifts to one side or the other of the display rack or if the center of gravity of the display rack moves too far rearwardly or forwardly.

One patent which discloses such a wheeled transport rack is U.S. Pat. No. 3,840,242. This patent discloses a transport rack having removable shelves, collapsible side panels and a base frame from which depend four caster wheels. This transport rack is not intended to display product or merchandise within a store but rather to transport product from one store location to another.

U.S. Pat. No. 2,918,295 also discloses a mobile wheeled display rack which is collapsible and which may be quickly and easily set up for display purposes and taken down for storage purposes.

Wheeled display racks are subject to attempts by employees to move such racks when racks are full of displayed merchandise even though these racks are not intended to be moved when full of product or merchandise, and even though such movement may jeopardize and potentially damage the displayed merchandise.

Therefore, a need exists for a wheeled display rack which becomes automatically immobilized when the display rack is full of product and yet is mobile when the display rack is empty of product. Such a display rack would enable a store employee to move the display rack when empty without the temptation of trying to move the display rack when full.

It has therefore been one objective of the present invention to provide a wheeled display rack which may be easily moved about when empty yet is immovable when the rack is full of product.

It has been a further objective of the present invention to provide a display rack having a wheeled support, including rotatable wheels, which support is movable between active and inactive positions and which in the active position, enables the rack to be rolled from one site to another but which when inactive, prevents rolling movement of the rack.

It has been a further objective of the present invention to provide a wheeled display rack having a wheeled support capable of supporting the display rack in an active position but not capable of supporting the display rack when in an inactive position.

SUMMARY OF THE INVENTION

The invention of this application which accomplishes these objectives comprises a wheeled display rack having a back panel, two side panels, a plurality of removable shelves and a wheeled support including rotatable wheels. The back panel is substantially planar defining a first plane. The two side panels are connected to opposed side edges of the back panel. The shelves are supportable from the side panels and back panel and may be easily removed from the display rack. The wheeled support includes rotatable wheels and is movable between an active position and an inactive position. When the wheeled support is in its active position, the display rack may be supported by the wheels of the wheeled support whereas if the wheeled support is its inactive position, the display rack may not be supported by the wheels of the wheeled support.

The invention of the present application includes two different embodiments, the wheeled support described hereinabove being different in the two different embodiments. The first embodiment of the present invention includes a wheeled support comprising a rear frame member for each side panel. A wheel bracket is secured to a lower portion of each rear frame member. A wheel is rotatably supported in each wheel bracket and is rotatable about a wheel axis. In this embodiment, the two rear frame members functioning as the wheeled support are rotatable from an active position to an inactive position. When the wheeled support is in its inactive position, the side panels of the display rack extend generally perpendicular to the back panel of the display rack enabling removable shelves on which product is displayed to be inserted between the side panels. When the side panels are extended in this position, the wheel brackets are generally co-planar with a first plane defined by the back panel and the wheel axis of each of the two wheels is generally perpendicular to the first plane. With the wheels in this position, the wheel axes being perpendicular to the first plane, the display rack is unable to be supported by the wheels and moved forward or backward. When the side panels are extended and the shelves inserted, the full weight of the product rests upon the front and rear frame members of the side panels preventing any movement of the display rack. With the side panels extended, the display rack may not be supported by the two wheels of the wheeled support even if the back panel is tilted rearwardly, therefore discouraging anyone from attempting to move the display rack when full of product and preventing potential damage to falling product.

When one wishes to change the location of the display rack, one removes all product from the shelves and then removes the shelves themselves. One then swings the two side panels inwardly to a collapsed position overlying the back panel, one side panel before the other. When the side panels are in their collapsed position, both side panels lie directly in front of the back panel, one of the side panels being sandwiched between the other side panel and the back panel. In order for the side panels to collapse into their collapsed position, the removable shelves must be removed, significantly lightening the load on the frame members of the side panels.

When the side panels are in a collapsed position generally parallel to the back panel, the orientation of the wheel brackets attached to the rear frame members of the side panels changes approximately 90° from their position when the side panels are extended. With the side panels in their collapsed position and the display rack empty of product, the wheel axes are generally parallel the first plane defined by the back panel and the wheels forwardly directed. With the wheels so oriented, the display rack may be easily moved forwardly or rearwardly by simply tilting the back panel rearwardly from a vertical orientation causing the weight of the display rack to be supported by the two wheels fixedly mounted to the rear frame members of the side panels. In this position, with the side panels collapsed and the back panel tilted rearwardly, the display rack may be easily rolled forwardly or backwardly.

Thus, the orientation of the wheel brackets, wheels and rear frame members of the side panels prevents the display rack from being movable when the side panels are extended and shelves are placed on the rack and enables the display rack to be easily moved when the side panels are collapsed and the display rack empty of product.

In an alternative embodiment of the present invention, the wheeled support comprises a tiltable wheel carriage secured to the back panel of the display rack. Two rotatable spaced parallel wheels are rotatably supported by the wheel carriage. The wheel carriage comprises two L-shaped members, each L-shaped member having a loop at one end thereof. The two L-shaped members are held in a spaced parallel relationship by at least one cross bar. A wheel is rotatably supported at the end of each L-shaped member opposite the end which has the loop thereon. The loops of the L-shaped members of the wheel carriage slidably receive a portion of the back panel of the display rack.

The wheeled carriage is oriented relative to the back panel such that a horizontal attachment bar located at a lower portion of the back panel slidably passes through the loops at the ends of the L-shaped members of the wheel carriage. The wheel carriage therefore cannot become separated from the back panel of the display rack.

As in the first embodiment, the display rack is movable when the wheeled support is in an active position and is immovable when the wheeled support is in its inactive position. When the wheeled support is in its active position, the display rack is supportable on the two wheels of the wheel carriage if the back panel is tilted rearwardly from a substantially vertical position. The display rack may or may not have swingable side panels which are capable of moving between a collapsed position in which they overlay the back panel to an extended position in which they are generally perpendicular to the back panel. Unlike the first embodiment, in the second embodiment, the orientation of the side panels is irrelevant to whether the wheeled support is in an active position or an inactive position. The display rack is movable forwardly and backwardly when the wheeled support is in its active position and is not movable forwardly and backwardly when the wheeled support is in its inactive position.

In its inactive position, the wheel carriage is located generally in front of the plane defined by the back panel of the display rack with the wheels supported generally on the floor but unable to support the weight of the display rack. The attachment bar of the back panel is located at the rearmost extreme of the loops of the L-shaped members of the wheel carriage.

In order to move the wheel carriage from its inactive position to its active position in which it is capable of supporting the display rack, the display rack must be tilted forwardly so that the back panel is forwardly inclined from a substantially vertical position and the side panels extended. When the display rack is in this position, the display rack is supported solely by two front feet at the lower ends of the front frame members of the side panels. With the back panel forwardly inclined, the weight of the wheel carriage and gravity swing the wheel carriage rearwardly such that the wheels of the wheel carriage swing back behind the plane defined by the back panel of the display rack. Once the wheels of the wheel carriage pass behind the plane of the back panel of the display rack, the display rack is tilted rearwardly until the back panel is in a substantially vertical position again and the display rack supported by all four members of the frames of the side panels. In this position, the wheels of the wheel carriage again contact the floor but at this time the wheels are behind the plane defined by the back panel of the display rack, and the wheel carriage is in its active position.

With the wheel carriage in its active position, the back panel of the display rack may now be tilted rearwardly from a substantially vertical position such that the weight of the display rack rests entirely upon the two wheels of the wheel carriage now located behind the plane defined by the back panel of the display rack. The display rack may then be moved forwardly or backwardly on the two wheels of the wheel carriage. When the wheel carriage is in its active position, the attachment bar of the back panel is located at the lowermost portion of the loops in the L-shaped members of the wheel carriage.

In order for the display rack to be tilted forwardly and supported solely on the two front legs of the side panels, the display rack must be empty of product. If the display rack were full of product, the weight of the product would prevent an employee from lifting the back panel upwardly enough to enable the wheel carriage to swing rearwardly into its active position.

Thus, a display rack is provided having a wheeled support which is movable from an inactive position to an active position enabling the display rack to be easily moved about when empty and prevent it from being moved when full. Thus, the ability of the wheeled support to move from an active position to an inactive position prevents employees from endangering product while attempting to move the display rack while it is full of product. This advantage and others of the invention will become more readily apparent from the following description of the drawings in which:

DESCRIPTION OF THE PREFERRED EMBODIMENTS

Figure 1:
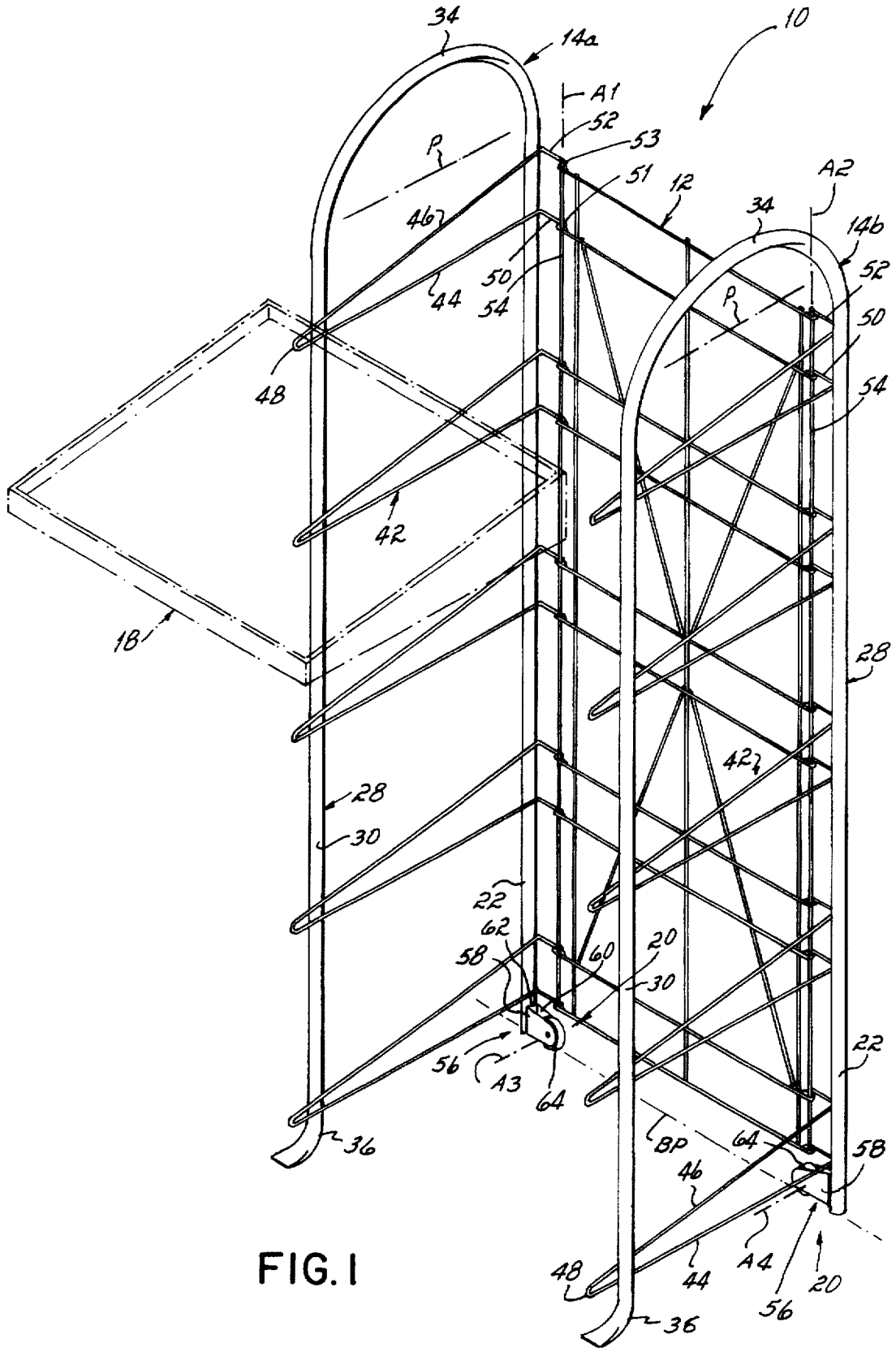
FIG. 1 is a perspective view of the wheeled display rack of the present invention in an expanded position including a representative removable shelf shown in dotted lines.
Figure 2:
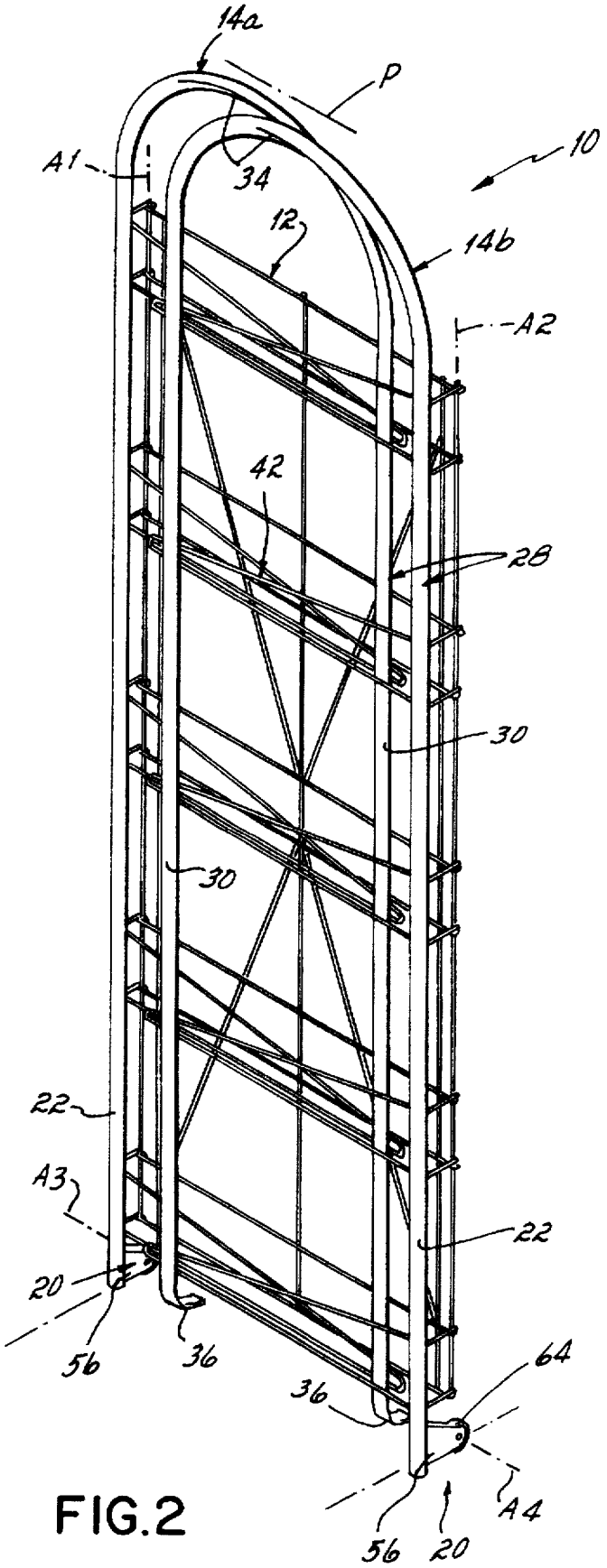
FIG. 2 is a perspective view of the wheeled display rack of FIG. 1 in a collapsed position.
Figure 3:
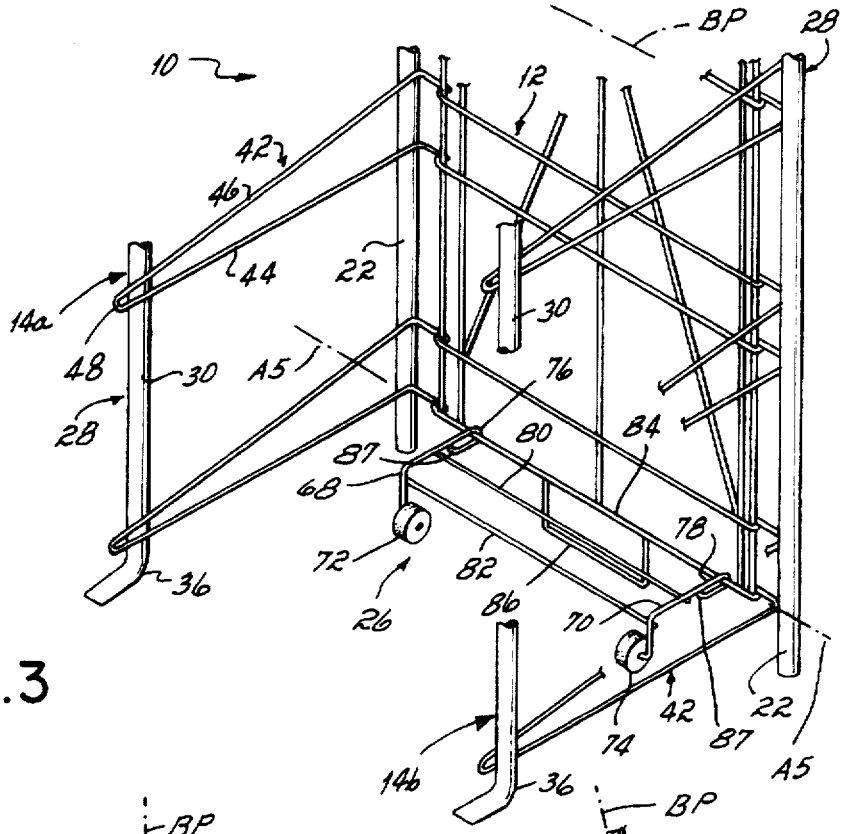
FIG. 3 is a fragmentary perspective view of a second embodiment of the present invention, the wheeled support being a wheel carriage illustrated in an inactive position.

Referring to the drawings, and particularly to FIG. 1, there is illustrated a wheeled display rack 10 adapted to be moved about inside a store and set up at a desired location before being loaded with product or merchandise. The display rack comprises a back panel 12, two side panels 14a, 14b, a plurality of removable shelves 18 and a wheeled support 20. As illustrated in FIGS. 1 and 2, wheeled support 20 may take the form of two rear frame members 22, 22 of the side panels 14a, 14b respectively. Alternatively, the wheeled support may take the form of a wheeled carriage 26 as best illustrated in FIG. 3. In both embodiments, the wheeled support is movable between an active position in which the display rack may be supported and moved by the wheeled support and an inactive position in which the display rack may not be supported and moved by the wheeled support.

Turning now to the embodiment illustrated in FIGS. 1 and 2, this first embodiment of the present invention requires that the two side panels 14a, 14b be collapsible. The side panels 14a, 14b are swingable between an extended position in which the side panels 14a, 14b are generally perpendicular to the back panel 12 (see FIG. 1) and a collapsed position in which the side panels 14a, 14b overlay the back panel 12 and are generally parallel the back panel (see FIG. 2). In order to move from an expanded position to a collapsed position, each of the side panels 14a, 14b is swingable about an axis. The axis about which side panel 14a swings is identified as A1 and the axis about which side panel 14b swings is identified as A2. Both axes A1 and A2 are located on the sides of the back panel 12.

For the sake of simplicity and to make reading this document easier, part numbers for the side panels 14a, 14b have been kept the same for each of the two side panels. Each of the side panels 14 comprises a generally U-shaped frame member 28. The generally U-shaped frame member 28 comprises a front member 30, a rear member 22 and a U-shaped top portion 34. Although the top portion is illustrated as being U-shaped, it could just as well be horizontal making the side panel generally rectangular. Alternatively, the side panels 14 could be any number of shapes. The front members 30 of the frames 28 have a radiused outward projection or foot 36 at the lowermost portion 38 of the front member 30.

Each of the side panels 14 further comprises a plurality of shelf supports 42. Each of these shelf supports 42 is generally V-shaped and has a generally horizontal first leg 44 and a downwardly and forwardly shaped second leg 46, the first and second legs 44, 46 being joined together at a juncture 48. The first leg 44 has an extension 50 generally perpendicular to the plane P defined by the side panel 14 and the second leg 46 also has an extension 52 generally perpendicular to the plane P defined by the side panel 14. Both the first and second legs 44, 46 of each shelf support 42 are affixed to the frame member 28 using any conventional connection (not shown), as for example, by being welded thereto. The ends 51, 53 of extensions 50 and 52 respectively are secured to a vertically oriented rod 54. The rod 54 is secured to the side edges of the back panel 12 so that the side panel 14 may be pivoted about axis A1 or A2. The orientation of the shelf supports 42 are such that the first leg 44 is horizontal and the second leg 46 is declined in a direction away from the back panel 12. This type of shelf support causes the shelves 18, when placed upon shelf supports 42, to be declined in a direction away from the back panel 12. This invention is not intended, however, to be limited to declined shelves. The shelf supports 42 and the shelves 18 may be horizontal or inclined as well.

When the side panels 14 are in their extended position which is generally perpendicular the back panel 12 as seen in FIG. 1, the shelves 18 may be placed upon the shelf supports 42 and product such as beverage containers (not shown) placed upon the shelves 18. The shelves 18 are declined in order to advance product to the front of the shelves where it is easily accessible to a consumer. When the shelves are removed, the side panels 14 of the display rack 10 may be pivoted about axes A1 and A2 causing the rear frame members 22 of the side panels 14, to rotate 90°. If the shelves 18 are in place, the side panels 14 may not be collapsed.

At the lower portion of each rear frame member 22 is attached a wheel bracket 56. The wheel bracket 56 comprises a first ear 58, a second ear 60 generally parallel the first ear 58 and spaced therefrom and a center portion 62. The center portion 62 is affixed, as by welding, to the rear frame member 22. A wheel 64 is rotatably supported in each wheel bracket 56. Each of the wheels 64 is rotatable about an axis, A3 for side panel 14a and A4 for side panel 14b.

When the side panels 14 are in their extended position as illustrated in FIG. 1, the axes of rotation A3 and A4 are generally perpendicular to a plane BP defined by the back panel 12. In this orientation, the wheels 64 are unable to support the display rack even if the back panel of the display rack were tilted rearwardly. Consequently, with the wheels 64 in this position, the display rack may not be wheeled from place to place.

However, when the side panels 14 are swung inwardly to their collapsed position overlying the back panel 12, the rear frame members 22 of the side panels 14 rotate 90° causing the wheel brackets 56 and wheels 64 therein to rotate 90°. With the side panels 14 in a collapsed position as illustrated in FIG. 2, the axes of rotation A3 and A4 of the wheels 64 are generally parallel the plane BP defined by the back panel 12 with the wheels 64 and wheel brackets 56 being located behind the plane BP. With the wheels 64 so oriented, the display rack may be supported by the two wheels and moved forwardly or backwardly.

This spacial orientation of the wheels, wheel brackets and side panels prevents the display rack from being wheeled about when the side panels are generally perpendicular to the plane defined by the back panel, yet enables the display rack to be easily wheeled about when the side panels are collapsed. The side panels may not be collapsed without emptying the display rack of product and removing the shelves thus ensuring that an operator does not attempt to move a full display rack.

In a second embodiment of the present invention illustrated in FIGS. 3–7, the wheeled support is a wheel carriage 26 which is swingable between an active position (FIG. 7) in which the wheel carriage 26 is located behind the plane BP defined by the back panel 12 of the display rack and an inactive position (FIG. 4) in which the wheel carriage 26 is located generally in front of the plane BP. In its inactive position, the wheel carriage 26 is not able to support the weight of the display rack even when the display rack is empty. In its active position, the wheel carriage 26 is able to support the weight of an empty display rack but not the weight of a full display rack. In this embodiment of the invention, the two side panels 14a, 14b need not be collapsible and may be fixedly attached to the sides of a back panel although it is preferred that, as illustrated, they be collapsible in the same manner as the side panels of the embodiment of FIGS. 1 and 2 are collapsible.

As best illustrated in FIG. 3, the wheel carriage 26 itself comprises two L-shaped members 68 and 70. One end of each L-shaped member rotatably supports a wheel, L-shaped member 68 supporting wheel 72 and L-shaped member 70 supporting wheel 74. At the other end of each L-shaped member is a loop forming a closed elongated slideway; L-shaped member 68 having loop 76 and L-shaped member 70 having loop 78. The two L-shaped members 68 and 70 are held in a spaced apart parallel relationship by a first cross bar 80 and a second cross bar 82, the cross bars being generally parallel one another. The wheel carriage 26 is slidably secured to the back panel 12 by an essentially horizontal attachment bar 84 of the back panel 12 passing through the loops 76, 78 of the L-shaped members 68, 70 respectively. The attachment bar 84 is free to slidably move inside the loops 76 and 78 as the wheel carriage 26 rotates from its active position to its inactive position. A stabilizing loop 86 depends from the lower edge of back panel 12, the purpose for which will be described below.

Figure 4:
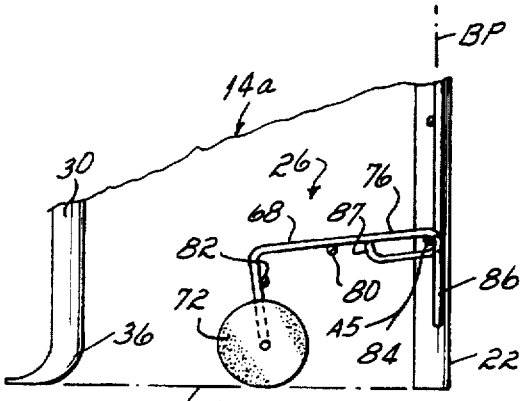
FIG. 4 is a partial side elevational view of the wheel carriage of FIG. 3 shown in its inactive position in front of the back panel of the display rack.

Turning to FIG. 4, the wheel carriage 26 is illustrated in its inactive position in front of the plane BP defined by the back panel 12. The wheels 72, 74 are located on the ground or floor F. In this position, the wheels 72, 74 of the wheel carriage 26 do not function in any way but are merely stored in this position. When the wheel carriage is in this position, the display rack is typically full of product and supported by the frame members of the side panels.

Figure 5:
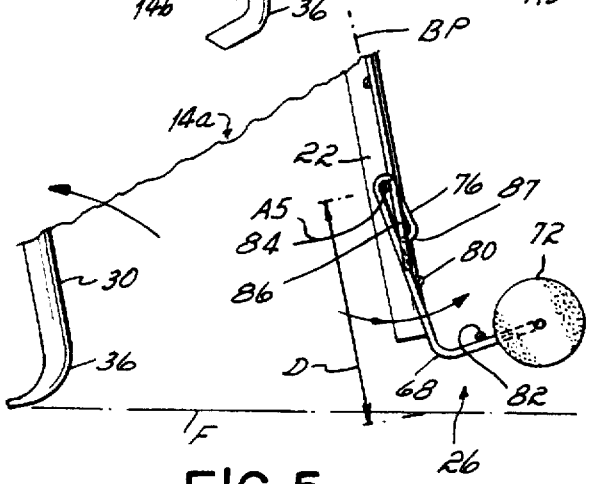
FIG. 5 is a partial side elevational view illustrating the display rack of FIG. 3 tilted forwardly shifting the weight of the display rack to the feet of the front members of the side panels allowing the wheel carriage to swing behind a plane defined by the back panel.

In order to move the display rack from one location to another, the display rack must be emptied of product and the wheel carriage 26 moved from its inactive position to its active position. In order to accomplish this movement, the weight of the product must be removed from the display rack. The shelves may or may not be removed. When the display rack is emptied of product, the side panels 14 must remain extending generally perpendicular to the back panel 12. As illustrated in FIG. 5, the display rack is tilted forwardly so that the back panel 12 is no longer substantially vertical but rather forwardly inclined causing the rear frame members 22, 22 of the side panels 14*a*, 14*b* to lift off the floor F. The entire weight of the display rack is now resting upon the front feet 36 of the front frame members 30 of each of the side panels 14. The weight of the wheel carriage 26 causes the wheel carriage to rotate counter-clockwise as illustrated in FIG. 5 so that the wheels 72, 74 and the L-shaped members 68, 70 of the wheel carriage 26 are located behind the plane BP defined by the back panel. In order for the wheel carriage 26 to swing backwardly to this position, the display rack must be tilted forwardly so much that distance D is at least great enough to allow wheel carriage 26 and particularly the axes of wheels 72, 74 to swing about attachment bar 84 so that the wheel axes and the first cross bar 80 of wheel carriage 26 move beyond plane BP.

Figure 6:
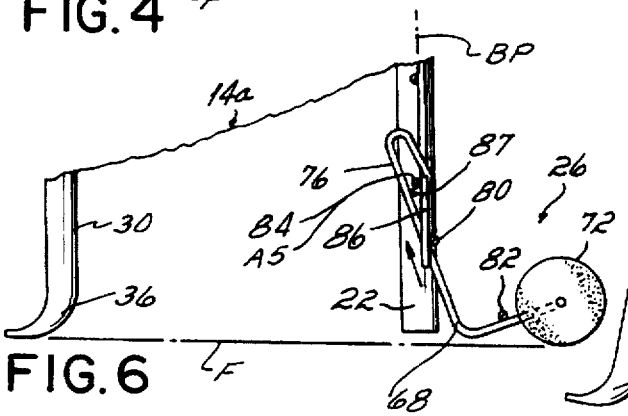
FIG. 6 is a partial side elevational view of the wheel carriage in its active position with the wheels of the wheel carriage located behind the back panel.
Figure 7:
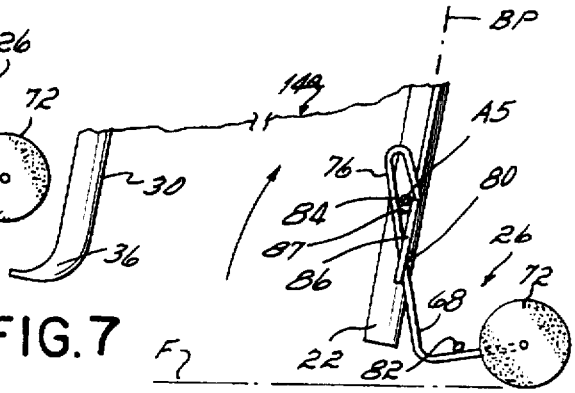
FIG. 7 is a partial side elevational view of the display rack tilted rearwardly and being supported by the two wheels of the wheel carriage while the wheel carriage is in its active position.

During the transition from its inactive position of FIG. 4 to its active position of FIGS. 6 and 7, the wheel carriage 26 passes generally underneath the back panel 12. The weight of the wheel carriage 26 causes the wheel carriage 26 to rotate counter-clockwise about an axis A5 defined by attachment bar 84 of the back panel 12. The wheels 72, 74 and first cross bar 80 of the wheel carriage 26 pass beneath U-shaped stabilizer 86. When the rear frame members 22 of the side panels 14 are placed back upon the floor F, the first cross bar 80 of the wheel carriage 26 is prevented from moving forward by U-shaped stabilizer 86 and the loops 76, 78 came to rest on the attachment bar 84.

Once the wheels 72, 74 of the wheel carriage 26 are located behind the back panel 12 in the active position of the carriage, the back panel 12 of the display rack is lowered so that the rear frame members 22 of the side panels 14 rest on the floor F again as illustrated in FIG. 6. In this active position the wheels 72, 74 are located behind the back panel and are able to support the weight of an empty display rack. Also, the first cross bar 80 of wheel carriage 26 is positioned rearwardly of plane BP and specifically U-shaped stabilizer 86, while the ends 87 of loops 76, 78 abut attachment bar 84.

As illustrated in FIG. 7, in order to move the display rack from one location to another with the wheel carriage 26 in its active position, the front frame members 30 of the side panels 14 of the display rack are lifted by pulling backwardly on the top of the back panel 12 of the display rack causing the weight of the display rack to rest fully on the wheel carriage 26 and more particularly on the wheels 72, 74 of the wheel carriage 26. With the wheel carriage 26 in its active position, the display rack may be moved about easily as long as the display rack is empty and the back panel tilted rearwardly.

In order for the wheel carriage 26 to be moved from its active position of FIG. 7 back to its inactive position of FIG. 4, the front frame members 30 of the side panels 14 must be placed downwardly on the floor F by returning the back panel 12 to a substantially vertically oriented position. From this position the top of the back panel 12 must be forwardly inclined causing the weight of the display rack to rest fully upon the front frame members 30 of the side panels 14. As the top of the back panel 12 is moved forwardly, the wheels of the wheel carriage move downwardly and forwardly as the weight of the wheel carriage causes the wheel carriage to rotate clockwise. The loops 76, 78 move downwardly causing the attachment bar 84 to slide upwardly inside the loops 76, 78 of the wheel carriage 26. If the weight of the wheel carriage is not alone sufficient to cause the wheel carriage to begin swinging forwardly, the operator may have to kick or push the wheel carriage 26 to start the wheel carriage 26 moving forwardly and to position the wheels 72, 74 of the wheel carriage 26 in front of the plane BP. The back panel 12 is then lowered to a substantially vertically oriented position with the wheel carriage in its inactive position.

While we have described two preferred embodiments of the present invention, persons skilled in the art will appreciate changes and modifications which may be made without departing from the spirit of the invention. Therefore, we do not intend to be limited except by the scope of the following appended claims.

What is claimed is:

1. A wheeled display rack comprising:

a back panel defining a first plane;

two side panels connected to said back panel, a plurality of removable shelves supportable from said side panels and said rear panel, a tiltable wheel carriage secured to said back panel including rotatable wheels, said tiltable wheel carriage being movable between active and inactive positions, said display rack being supportable by said wheels of said tiltable wheel carriage in said active position and being unsupportable by said wheels of said tiltable wheel carriage in said inactive position so that said display rack is movable on said tiltable wheel carriage when said tiltable wheel carriage is in said active position and is immovable on said tiltable wheel carriage when said tiltable wheel carriage is in said inactive position.

2. The display rack of claim 1 wherein said wheels of said tiltable wheel carriage are located in front of said first plane when tiltable wheel carriage is in said inactive position.

3. The display rack of claim 1 wherein said side panels are pivotal about vertical axes.

4. The display back of claim 1 wherein said display rack is movable when said back panel is tilted rearwardly from a substantially vertical position and is immovable when said back panel is in a substantially vertical position.

5. A collapsible wheeled display rack comprising:

a back panel defining a first plane;

two side panels hingedly connected to said back panel, said side panels being capable of swinging from a collapsed position overlying said back panel to an expanded position generally perpendicular said back panel, wheel brackets affixed to said side panels, wheels rotatable supported in said wheel brackets, said wheel brackets being oriented such that said display rack is supportable by said wheels and mobile when said side panels are in said expanded position and said display rack is unsupportable by said wheels and immobile when said side panels are in said collapsed position.

6. The display rack of claim 5 wherein said wheel brackets are affixed to vertically oriented frame members of said side panels.

7. The display rack of claim 5 wherein said wheel brackets are affixed to lower portions of vertically oriented rear frame members of said side panels.

8. The display rack of claim 5 wherein each of said wheel brackets comprises a pair of parallel spaced ears.

9. The display back of claim 5 wherein said display rack is movable when said back panel is angled from a substantially vertical position and is immovable when said back panel is in a substantially vertical position.

10. A collapsible wheeled display rack comprising:

a back panel defining a first plane;

two side panels hingedly connected to said back panel, each side panel having a rear frame member to which is fixedly attached a wheel bracket, a wheel rotatably supported in each wheel bracket, each wheel being rotatable about a wheel axis, said side panels being capable of swinging from a collapsed position overlying said back panel to an expanded position generally perpendicular said back panel, said wheel axes being generally perpendicular said first plane when said side panels are in said expanded position, preventing said display from being rolled forward or backward and said wheel axes being generally parallel said first plane when said side panels are in said collapsed position so as to enable said display to be rolled forward or backward.

11. The display rack of claim 10 further comprising a plurality of removable shelves extending between said side panels when said side panels are in said expanded position.

12. The display rack of claim 10 wherein each side panel comprises a U-shaped frame member to which is attached a plurality of shelf supports.

13. The display rack of claim 12 wherein said shelf supports are declined in a direction away from said back panel, causing said shelves to decline when placed upon said shelf supports.

14. A wheeled collapsible display rack comprising:

a substantially planar back panel defining a first plane;

two side panels hingedly connected to said back panel, each side panel having a rear frame member, a wheel bracket secured to a lower portion of each rear frame member, each wheel bracket rotatably supporting a wheel therein; said wheel being rotatable about a wheel axis, each side panel being capable of swinging between a collapsed position in which said side panel overlies and is generally parallel said back panel and an expanded position in which said side panel is generally perpendicular said back panel, said wheel axis being generally perpendicular said back panel when said side panel is in said expanded position, preventing said display rack from being rolled forward or backward in a direction perpendicular said first plane.

15. The display rack of claim 14 wherein each rear frame member of each side panel rotates approximately 90 degrees when said side panel moves between said collapsed position and said expanded position.

16. The display rack of claim 14 one of said side panels is folded inwardly overlying and abutting said back panel and the other of said side panels is folded inwardly overlying and abutting said one of said side panels when said display rack is in said collapsed position.

17. The display rack of claim 14 further comprising a plurality of removable shelves extending between said side panels when said side panels are in said expanded position.

18. The display rack of claim 14 wherein said shelves are declined in a direction away from said back panel.

19. A collapsible wheeled display rack comprising:

a back panel defining a first plane, two side panels, each side panel being hingedly connected to said back panel about a vertical axis, said side panels being capable of extending from a collapsed position in which said side panels are generally parallel said first plane to an expanded position in which said side panels are generally perpendicular said first plane, a tiltable wheel carriage secured to a lower portion of said back panel, two spaced, parallel wheels rotatably supported by said wheel carriage, said wheel carriage being capable of tilting between a first position in which said wheels are located in front of said first plane and a second position in which said wheels are located behind said first plane, said rack being supportable from said wheel carriage and movable upon said wheel carriage only when said wheels are located behind said first plane.

20. The display rack of claim 19 further comprising a plurality of removable shelves.

21. The display rack of claim 20 wherein said removable shelves are supportable from said side panels and said rear panel.

22. The display rack of claim 19 wherein said wheel carriage is slidably secured to said back panel.

23. The display rack of claim 19 wherein said wheel carriage comprises two L-shaped members, each L-shaped member having a closed elongated slideway formed by a loop at one end thereof, said L-shaped members being held in a spaced parallel relationship by at least one cross bar.

24. The display rack of claim 23 wherein said slideways formed by said loops of said L-shaped members of said wheel carriage slidably receive a bar of said back panel.

25. The display rack of claim 23 wherein said wheel carriage is secured to said back panel by a horizontal bar of said back panel passing through said slideways of said loops of said L-shaped members of said wheel carriage.

26. A wheeled display rack comprising:

a back panel defining a first plane, two side panels connected to said back panel, each side panel comprising a generally U-shaped frame member a tiltable wheel carriage secured to said back panel, two spaced, parallel wheels rotatably supported on said wheel carriage, said wheel carriage being capable of tilting between a first position in which said wheels are located in front of said first plane and a second position in which said wheels are located behind said first plane, said rack being supportable from said wheel carriage and movable upon said wheel carriage only when said wheel carriage is in said second position and said wheels are located behind said first plane.

27. The display rack of claim 26 further comprising a plurality of removable shelves.

28. The display rack of claim 26 wherein said removable shelves are supportable from said side panels and said rear panel.

29. The display rack of claim 26 wherein said wheel carriage is slidably secured to said back panel.

30. The display rack of claim 26 wherein said wheel carriage comprises two L-shaped members, each L-shaped member having a loop at one end thereof, said L-shaped members being held in a spaced parallel relationship by at least one cross bar.

31. The display rack of claim 30 wherein said loops of said L-shaped members of said wheel carriage slidably receive a portion of said back panel.

32. The display rack of claim 30 wherein said wheel carriage is secured to said back panel by a horizontal bar of said back panel passing through said loops of said L-shaped members of said wheel carriage.

* * * * *

UNITED STATES PATENT AND TRADEMARK OFFICE

CERTIFICATE OF CORRECTION

PATENT NO. : 5,765,702

DATED : June 16, 1998

INVENTOR(S) : Rafael T. Bustos and Joseph Marcus Battaglia

It is certified that error appears in the above-identified patent and that said Letters Patent is hereby corrected as shown below:

Column 8, line 66, please delete "back" and replace with --rack--.

Column 9, line 6, please delete "back" and replace with --rack--.

Column 9, line 15, please delete "expanded" and replace with --collapsed--.

Column 9, line 17, please delete "collapsed" and replace with --expanded--.

Signed and Sealed this

Eighteenth Day of April, 2000

*Attest:*

Q. TODD DICKINSON

*Attesting Officer*

*Director of Patents and Trademarks*